US006716467B2

(12) United States Patent
Cole et al.

(10) Patent No.: US 6,716,467 B2
(45) Date of Patent: Apr. 6, 2004

(54) FOOD OVEN WITH EVEN HEAT DISTRIBUTION

(75) Inventors: James T. Cole, Algonquin, IL (US); Mimmo Elia, Watertown, MA (US); Anthony Patti, Wakefield, MA (US)

(73) Assignee: Gas Research Institute, Des Plaines, IL (US)

( * ) Notice: Subject to any disclaimer, the term of this patent is extended or adjusted under 35 U.S.C. 154(b) by 0 days.

(21) Appl. No.: 09/835,078

(22) Filed: Apr. 13, 2001

(65) Prior Publication Data

US 2002/0148362 A1 Oct. 17, 2002

(51) Int. Cl.[7] ..... A21B 1/26

(52) U.S. Cl. ..... 426/466; 426/523; 99/330; 99/475; 99/476; 99/480; 126/21 A; 219/400

(56) References Cited

U.S. PATENT DOCUMENTS 3,861,378 A * 1/1975 Rhoads et al. ..... 126/21 A
4,108,056 A * 8/1978 Van Elten et al. ..... 99/452
4,160,440 A * 7/1979 Barnickle ..... 126/110 R
4,307,286 A * 12/1981 Guibert ..... 219/400
4,308,853 A * 1/1982 Thirode ..... 126/21 A
4,455,478 A * 6/1984 Guibert ..... 219/400
4,515,143 A 5/1985 Jabas ..... 126/21 A
4,779,604 A 10/1988 König ..... 126/21 A
5,129,384 A 7/1992 Parks ..... 126/21 A
5,568,802 A 10/1996 Buday et al. ..... 126/21 A
5,617,839 A 4/1997 Jennings et al. ..... 126/20
6,320,165 B1 * 11/2001 Ovadia ..... 219/400

* cited by examiner

*Primary Examiner*—Drew Becker
(74) *Attorney, Agent, or Firm*—Mark E. Fejer

(57) ABSTRACT

An oven assembly having oppositely disposed first and second wall structures enclosing a cooking chamber, each wall structure having a plurality of spaced apart openings for passage of air therethrough. A rotating valve is provided, which is in heated air receiving communication and return air communication with a heat source and in heated air distributing communication with the first wall structure and in return air communication with the second wall structure whereby heated air is passed through the spaced apart openings in the first wall structure into the cooking chamber and return air from the cooking chamber is passed through the spaced apart openings in the oppositely disposed second wall structure and to the rotating valve for return to the heat source. The rotating valve is rotatable to be in heated air distributing communication with the second wall structure and in return air communication with the first wall structure.

17 Claims, 3 Drawing Sheets

FOOD OVEN WITH EVEN HEAT DISTRIBUTION

BACKGROUND OF THE INVENTION

This invention relates generally to ovens useful for cooking or heating food products and, more particularly, to ovens such as may be used to more evenly bake or roast food products.

In the commercial foodservice industry, it is common to employ baking/ roasting ovens that have a chamber or oven cavity sized sufficiently large to receive multiple layers of a food product to be cooked, in a single load. For example, typical or standard ovens may have provision for up to 8 cake or food trays each measuring 18 by 26 inches. Heating of the food product in such a cooking process is typically accomplished via heat supplied via a natural gas or oil burner or one or more electric heating elements.

Many convection ovens are equipped with fans capable of moving heated air throughout the cooking chamber at various velocities. Normally, such ovens are designed to provide a rapid distribution of heated air over food products which have been placed on pans stacked one above the other. Unfortunately, the distribution of heated air in such ovens is not always as uniform as may be desired. As a result, food products arranged in the cooking cavity and being cooked, e.g., baked, in such an oven may cook at uneven speeds. As a result, particular food products of a single batch can be cooked in an undesirable fashion, such as to various degrees of doneness and coloring, for example.

In an effort to improve such cooking results, various oven designs and methods have been proposed or developed. These oven designs and methods include rotating the food product while in the oven cooking cavity and the use of reversing blowers to change the airflow pattern in or through the oven cooking cavity. While such oven designs and methods may provide or result in certain improvements in cooking operation and results, they are also typically subject to certain or various shortcomings or limitations. For example, oven units that rotate the food product generally require more room to permit rack rotation. Further, the inclusion of a rack rotation mechanism and associated power drive can undesirably increase unit costs as well as increase maintenance costs such as due to the number and magnitude of moving parts included therewith.

One approach directed to solving or reducing at least some of these problems or concerns is disclosed in U.S. Pat. No. 4,779,604, issued Oct. 25, 1988. This patent discloses a baking oven which includes a baking chamber and has air channels extending at both sides of the baking chamber as well as over the height of the baking chamber from top to bottom. The air channels are separated from the baking chamber by partition walls having provided therein air flow openings formed by horizontal slots. As disclosed, heated air is blown in alternating directions into the baking chamber by means of a blower such as by way of reversing the sense of rotation of the blower.

Unfortunately, the inclusion and reliance on reversible blowers has associated with it a number of complications or shortcomings. For example, reversible blowers require the inclusion of an appropriate brake mechanism to permit the direction of blowing to be reversed. Further, the subjection of a blower to repeated or ongoing stoppages and reversals can be undesirably hard on a blower motor and can lead to an increased frequency of breakdowns, needed repairs or maintenance downtime.

As a result, there is a continuing need and demand for improved oven assemblies and associated or related methods of operation for the cooking of food products such as to produce or result in even heat energy distribution within the cooking chamber cavity.

SUMMARY OF THE INVENTION

A general object of the invention is to provide improved oven assemblies and associated or related methods of operation for the cooking of food products.

Another general object of the invention is to provide such oven assemblies and associated or related methods of operation for the cooking of food products such as to produce or result in even heat energy distribution within the cooking chamber cavity.

A more specific objective of the invention is to overcome one or more of the problems described above.

The general object of the invention can be attained, at least in part, through a specific oven assembly for the cooking of food products. An oven assembly, in accordance with one preferred embodiment of the invention, includes a cooking chamber. The cooking chamber is defined at least in part by a first pair of oppositely disposed first and second wall structures. Each of the first and second wall structures includes a plurality of spaced apart openings for the passage of air therethrough. The oven assembly also includes a rotating valve. The rotating valve is in both heated air receiving communication and return air communication with a heat source. At a selected point in time, the rotating valve is in heated air distributing communication with the first wall structure and in return air communication with the second wall structure of the first pair of oppositely disposed first and second wall structures, such that heated air is passed through the plurality of spaced apart openings in the first wall structure into the cooking chamber and return air from the cooking chamber is passed through the plurality of spaced apart openings in the oppositely disposed second wall structure and to the rotating valve for return to the heat source. The rotating valve is capable of rotation to be in heated air distributing communication with the second wall structure and in return air communication with the first wall structure.

The prior art has generally failed to provide large scale oven assemblies and associated or related methods of operation for the cooking of food products which produce or result in even heat energy distribution within the cooking chamber cavity in an as effective a manner as desired. Such shortcomings are particularly significant and noticeable in applications such as in the commercial foodservice industry such as commercial bakeries and the like, for example.

The invention further comprehends a commercial baking oven assembly for the baking of food products, such as with a more even heat distribution. In accordance with one preferred embodiment of the invention, such an oven assembly includes a baking chamber defined at least in part by a first pair of oppositely disposed first and second wall structures, each of the first and second wall structures including a plurality of spaced apart openings for the passage of air therethrough. The oven assembly also includes a rotating valve. The rotating valve is in both heated air receiving communication and return air communication with a burner assembly. At a selected point in time, the rotating valve is in heated air distributing communication with the first wall structure and in return air communication with the second wall structure of the first pair of oppositely disposed wall structures such that heated air is passed through the plurality of openings in the first wall structure into the baking chamber and return air from the baking chamber is passed through the plurality of openings in the oppositely disposed second wall structure and to the rotating valve for return to the burner assembly. The rotating valve is capable of rotation to be in heated air distributing communication with the second wall structure and in return air communication with the first wall structure of the first pair of oppositely disposed wall structures at a subsequent selected point in time.

The invention still further comprehends a method of operating an oven for the cooking of food products with even heat energy distribution. In such method, the oven includes a cooking chamber defined at least in part by a first pair of oppositely disposed first and second wall structures. In such oven, each of the first and second wall structures includes a plurality of spaced apart openings for the passage of air therethrough. The oven also includes a rotating valve in both heated air receiving communication and return air communication with a heat source. In accordance with one preferred embodiment of the invention, the method involves passing heated air from the heat source through the rotating valve and through the spaced apart openings in the first wall structure into the cooking chamber. In such method, return air from the cooking chamber is passed through the spaced apart openings in the second wall structure and the rotating valve to the heat source. The method further involves rotating the rotating valve to pass heated air from the heat source through the rotating valve and through the spaced apart openings in the second wall structure into the cooking chamber and return air from the cooking chamber through the spaced apart openings in the first wall structure.

The invention yet still further comprehends a method of operating a baking oven for the baking of food products with even heat energy distribution. In such method, the baking oven includes a baking chamber defined at least in part by a first pair of oppositely disposed first and second wall structures. Each of the first and second wall structures of the baking oven includes a plurality of spaced apart openings for the passage of air therethrough. The baking oven also includes a rotating valve in both heated air receiving communication and return air communication with a burner assembly. The rotating valve has a first state in which the rotating valve is in heated air distributing communication with the spaced apart openings of the first wall structure and in return air communication with the spaced apart openings of the second wall structure. The rotating valve also has a second state in which the rotating valve is in heated air distributing communication with the spaced apart openings of the second wall structure and in return air communication with the spaced apart openings of the first wall structure. In accordance with one preferred embodiment of the invention, the method involves rotating the rotating valve to sequentially alternate the rotating valve between the first and second states.

Other objects and advantages will be apparent to those skilled in the art from the following detailed description taken in conjunction with the appended claims and drawings.

DETAILED DESCRIPTION OF THE INVENTION

The present invention generally provides improved oven assemblies and associated or related methods of operation for the cooking of food products. In particular, the invention provides such improved oven assemblies and associated or related methods of operation which are helpful in providing or resulting in even heat energy distribution within the food cooking chamber of the oven. As detailed below, such even heat energy distribution within a food cooking chamber is in accordance with a preferred embodiment of the invention achieved at least in part via a rotating flow control device or valve such as permits a rapid cross-flow of heated air within the cooking chamber.

Figure 1:
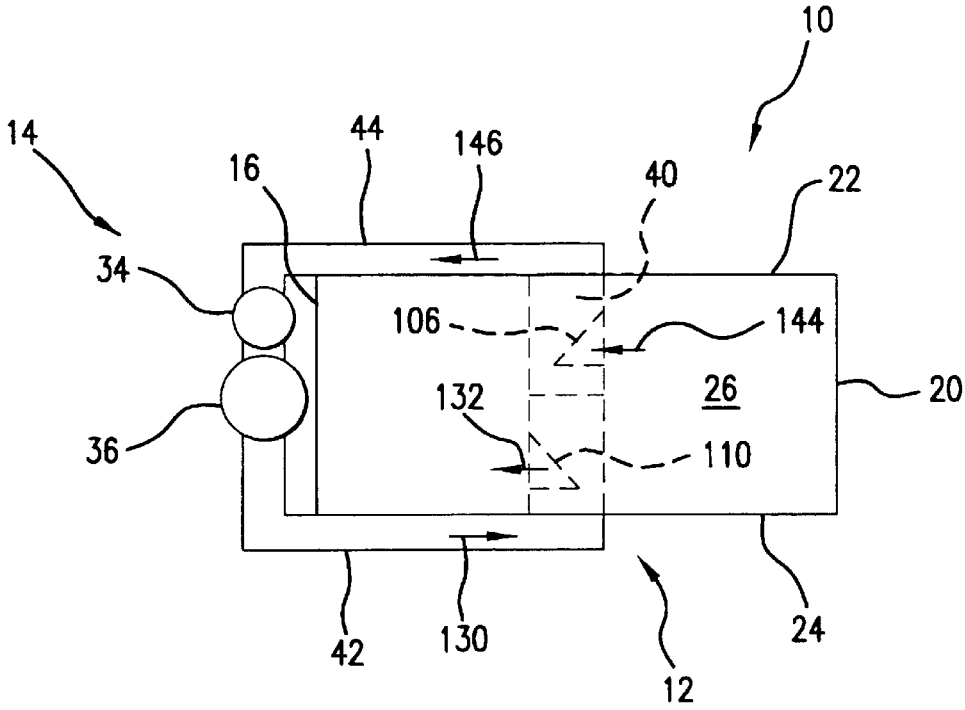
FIG. 1 is a simplified rear view schematic showing air distribution in an oven assembly for the cooking of food products in accordance with one embodiment of the invention.
Figure 2:
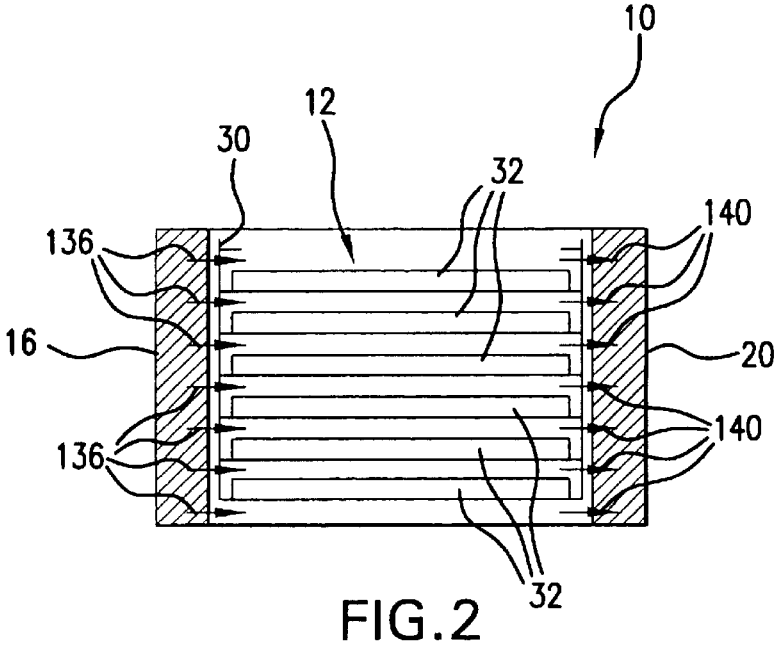
FIG. 2 is a simplified rear cross sectional view schematic showing air distribution in the cooking chamber of the oven assembly shown in FIG. 1, without showing the cooking chamber top or bottom in the cross sectional view.
Figure 3:
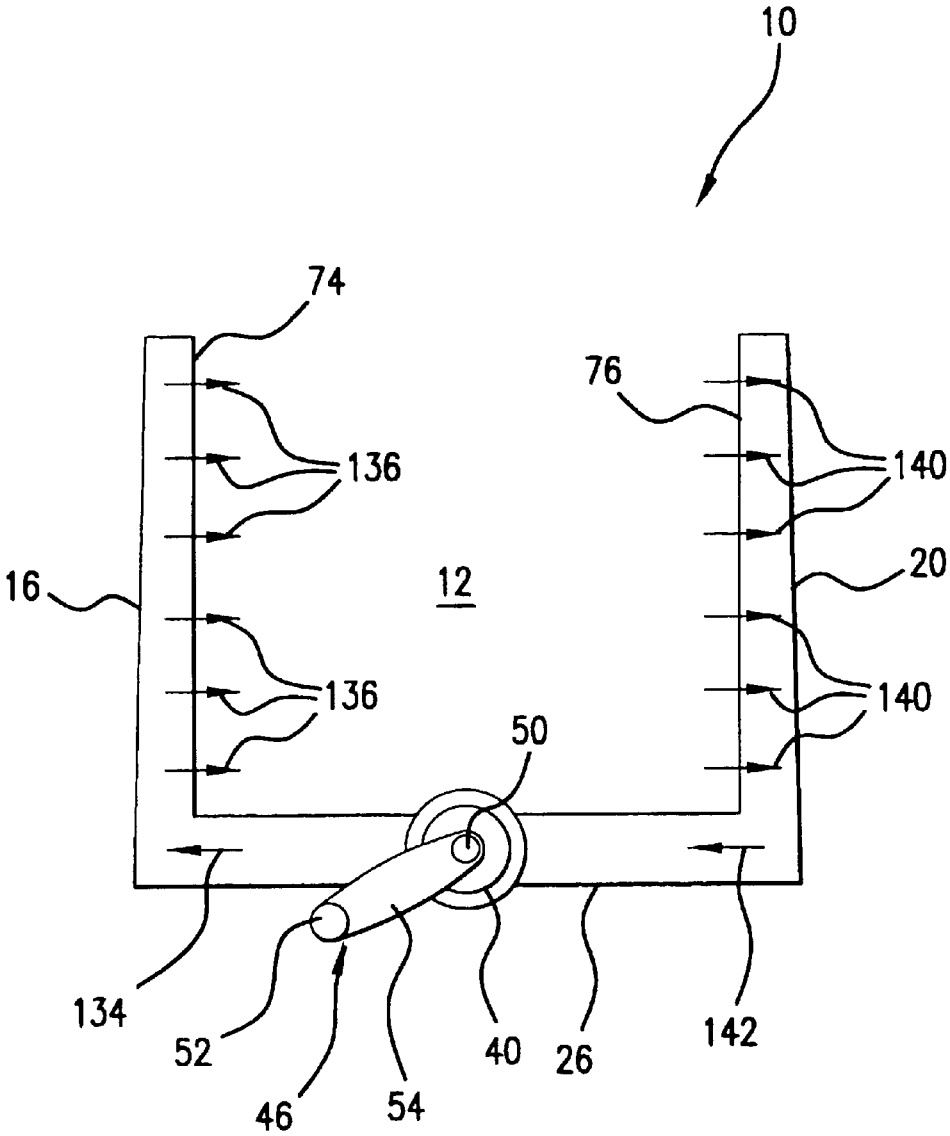
FIG. 3 is a simplified top view schematic showing air distribution through the cooking chamber in the oven assembly shown in FIG. 1.

The invention may be embodied in a variety of different structures. As representative, FIGS. 1–3 illustrate the present invention, as embodied in a food-cooking oven assembly or unit in accordance with one embodiment of the invention and generally designated by the reference numeral 10, in simplified forms as detailed below. As will be appreciated by those skilled in the art and guided by the teachings herein provided, oven assemblies in accordance with the invention can desirably find application in various foodservice production processes such as involving roasting and, particularly, baking, for example. Further, oven assemblies in accordance with the invention can be appropriately sized to accept or receive a rack with multiple shelves of food products to be cooked, such as described above.

The oven assembly 10 includes a generally rectangular shaped cooking chamber 12 and a heated air distribution and return air receiving assembly, generally designated 14, associated therewith. The cooking chamber 12 is defined at least in part by a first pair of oppositely disposed first and second wall structures, 16 and 20, respectively. The cooking chamber 12 also includes a top 22 and a bottom 24 (shown in FIG. 1) and a rear wall structure 26 and a front wall structure (not shown) such as in the form of an oven door as is known in the art to permit access to an associated cooking chamber.

The cooking chamber 12 is sized and shaped to permit the placement therein of food product in desired forms to permit the cooking thereof. For example, and consistent with above-described commercial food-cooking ovens, the cooking chamber 12 can be appropriately sized and shaped to accept or receive a rack, such as described above, with multiple shelves carrying food products to be cooked. In FIG. 2, a food-carrying rack is schematically shown and designated by the reference numeral 30. In the illustrated embodiment, the rack 30 carries six shelves or levels of food product 32.

The heated air distribution and return air receiving assembly 14 includes a heat source 34, such as in the form of a burner, a blower unit 36, a heated air distributing and return air receiving flow control device 40, also referred to herein as a rotating valve and described in greater detail below, as well as associated or corresponding heated air communicating ductwork 42 and return air communicating ductwork 44. To avoid undesirably complicating the figures, FIG. 1 has been simplified by primarily showing the heated air distribution and return air receiving assembly 14 with the air flow therein, with the cooking chamber 12 only being shown in outline form thereagainst.

The oven assembly 10 also includes a suitable arrangement or mechanism, generally designated 46 and shown in FIG. 3 to permit rotation of the valve 40. For example, a suitable rotation mechanism may include pulleys 50 and 52, an associated, transmission belt 54 and a motor (not shown) to effect the desired rotation. It will be appreciated, however, that various rotation mechanisms can be used in the practice of the invention and thus the broader practice of the invention is to be understood as not necessarily limited to use with particular or specific rotation mechanisms. For example, a rotation mechanism based on appropriate gear works may be utilized in the practice of the invention.

As will be appreciated by those skilled in the art and guided the teachings herein provided, in certain applications it may be desirable to selectively change or vary the speed at which the rotating valve of the invention is rotated. For example, the selected rotation mechanism may utilize or rely on either or both a variable speed motor or gear works which are unsymmetrical in shape such as to appropriately vary or change the speed of valve rotation such as to achieve desired heated air distribution in the oven and concomitant receiving of return air.

Figure 4:
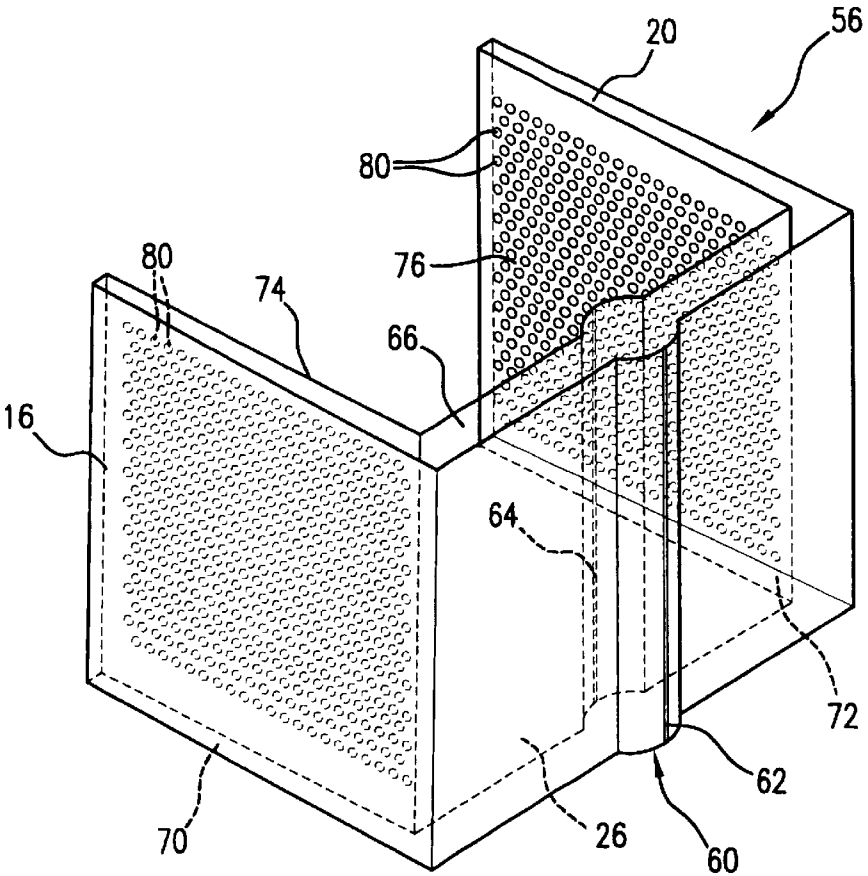
FIG. 4 is a simplified perspective view of a cooking chamber wall unit, in accordance with one preferred embodiment of the invention.

In accordance with a preferred embodiment of the invention, the cooking chamber rear wall structure 26 and oppositely disposed first and second wall structures, 16 and 20, can be formed or individual such wall structures joined or connected into a single cooking chamber wall unit, such as shown in FIG. 4 and designated by the reference numeral 56. The rear wall structure 26 includes an opening or cavity 60 shaped or adapted to receive the rotating valve 40. The rear wall structure 26 may include seals 62 and 64, such as in the form of wipers, such as to fit with the associated rotating valve and prevent or minimize undesired air flow in or from oven assemblies in accordance with the invention.

The rear wall includes a hollow volume 66 to permit heated air and return air to be appropriately transmitted therethrough in accordance with a preferred embodiment of the invention. Similarly, the first wall structure 16 and the second wall structure 20 each forms or includes a corresponding hollow volume, 70 and 72, respectively, to permit heated air and return air to be appropriately transmitted therethrough in accordance with a preferred embodiment of the invention.

Each of the first and second wall structures, 16 and 20, includes a cooking chamber-facing panel, 74 and 76, respectively. The panels 74 and 76 each include a plurality of spaced apart openings 80 for the passage of air therethrough. As detailed herein, the openings in one of the wall structures serve to permit discharge of heated air into the cooking chamber while the openings in the opposed wall structure serve to permit entry of return air from the cooking chamber for subsequent processing such as recycling to the heat source and vice versa upon proper rotation of the associated rotating valve.

Figure 5:
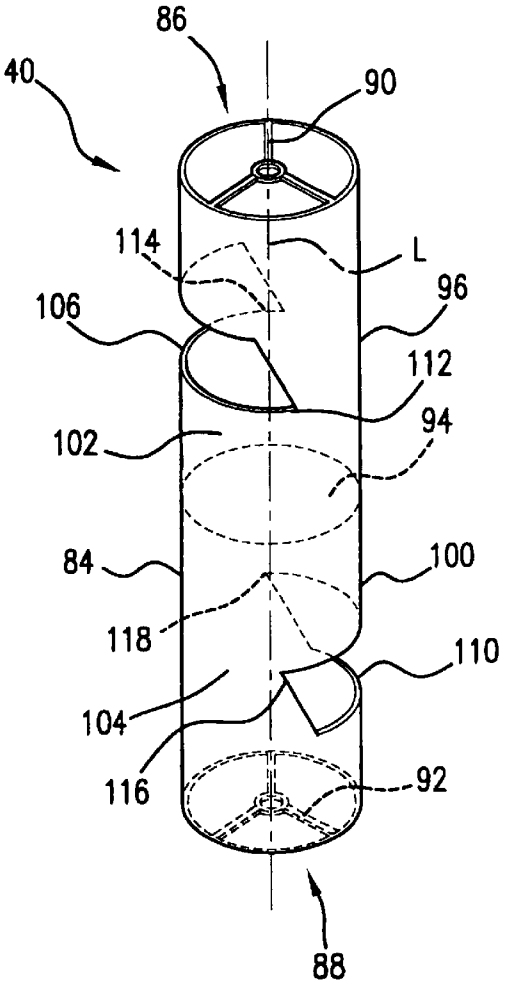
FIG. 5 is a simplified front perspective schematic view of a rotating flow control device or valve in accordance with one preferred embodiment of the invention.

Turning now to FIG. 5, the heated air distributing and return air receiving flow control device or rotating valve 40, in accordance with one preferred embodiment of the invention, is shown in isolation. The rotating valve 40 includes a generally cylindrical shaped side wall 84 and has a longitudinal axis designated "L." The side wall 84 has an open first end 86 and an open second end 88. The rotating valve 40 may also include end elements 90 and 92 such as disposed at or near the first and second ends, 86 and 88, respectively, such as to either or both lend structural support thereto or permit or facilitate the desired rotation movement of the valve 40. About midway between the first and second ends 86 and 88, the valve 40 includes a plate member divider 94 such as to divide the side wall 84 into upper and lower side wall portions 96 and 100, respectively, and the volume contained within the side wall 84 into upper and lower volume portions 102 and 104, respectively. Each of the upper and lower side wall portions 96 and 100, includes an opening 106 and 110, respectively.

In accordance with a preferred embodiment of the invention, the upper opening 106 and the lower opening 110 are generally oppositely disposed about the side wall 84, as shown in FIG. 5. The upper opening 106 includes end portions 112 and 114 at the opposite ends thereof. The lower opening 110 similarly includes end portions 116 and 118 at the opposite ends thereof. As explained further below, the upper opening end portion 112 is preferably over-center the lower opening end portion 116 and similarly, the upper opening end portion 114 is preferably over-center the lower opening end portion 118.

A food cooking process in accordance with one embodiment of the invention will now be described by first making reference to FIG. 1. The heat source 34 forms or produces heated air. The blower unit 36 then transmits or communicates the heated air through the heated air communicating ductwork 42, as signified by the arrow 130. The heated air enters the rotating valve 40 and is discharged through the lower opening 110 formed therein, as signified by the arrow 132.

The heated air discharged from the rotating valve 40, as shown in FIG. 3, is transmitted through the cooking chamber rear wall structure 26 to the first wall structure 16, as signified by the arrow 134. The heated air is passed through the adjoining side wall structure 16 and then discharged through the side wall chamber-facing panel 74 and into the cooking chamber 12, as signified by the arrows 136, shown in FIGS. 2 and 3. The heated air is passed or transmitted through the cooking chamber 12, past or across the food product(s) 32 therein contained, as shown in FIG. 2.

The resulting or corresponding return air from the cooking chamber 12 is passed through the opposing side wall chamber-facing panel 76 and into the associated wall structure 20, as signified by the arrows 140, shown in FIGS. 2 and 3. The return air is passed through the wall structure 20 and into cooking chamber rear wall structure 26, as signified by the arrow 142 shown in FIG. 3. The return air is transmitted through the upper opening 106 and into the rotating valve 40, as signified by the arrow 144, shown in FIG. 1. The return air is passed through the rotating valve 40 and the return air communicating ductwork 44 and to the heat source 34, as signified by the arrow 146.

As will be appreciated, rotation of the flow control device or valve of the invention results in a reversal in the direction of heated air flow within the oven cooking chamber. Through proper rotation of the flow control valve, the flow of heated air/return air within the cooking chamber can desirably be simply and effectively alternated between opposing cross-directions, with the result of such alternation being that the food product contained within the cooking chamber can desirably be cooked in a more uniform and consistent manner.

In accordance with one preferred embodiment of the invention, the rotating valve is rotated continuously during the cooking operation in a clockwise or a counterclockwise fashion. As a result, heated air is directed through the cooking chamber 12 in an alternating direction between the first and second side wall structures 16 and 20 and such as across a food product-carrying cooking rack therein contained.

Alternatively, rather than rotate in a single direction, the rotating valve may be rotated back and forth between a first state in which the rotating valve 40 is in heated air distributing communication with the openings of one of the wall structures 16 and 20 and in return air communication with the openings of the other of the wall structures 16 and 20 and a second state in which the rotating valve 40 is in reverse heated air distributing communication and return air communication with the openings of the wall structures 16 and 20.

Those skilled in the art and guided by the teachings herein provided will, however, appreciate that the speed at which the rotating valve is rotated can be appropriately selected to provide desired heat distribution within the cooking chamber dependent on various factors including the food product being cooked and the degree of doneness desired, for example. In practice it has been found that, when rotated continuously, a speed of rotation of about one-half to about five revolutions per minute for the rotating valve 40 has been found effective to produce or result in desired uniformity of heat energy distribution within the cooking chamber for customary food baking operations, with a rate of rotation of about one-half to about three revolutions per minute being particularly preferred for the cooking of at least certain food products, such as various baked goods.

The air flow control realized in a cooking chamber through the practice of the invention allows the heated air to be sequentially directed across cooking trays, first in one direction and then in the reverse direction, thereby subjecting the food product being cooked to an even exposure of heated air without requiring the rotation or movement of the food product.

As will be appreciated, oven assemblies in accordance with the invention may desirably include or incorporate appropriate seals, such as identified above, such as to avoid or minimize the amount or extent to which heated or return air may be misdirected or short circuit the desired and designed air flow to and from the rotating valve.

Further, those skilled in the art and guided by the teachings herein provided will appreciate that the number as well as the size, form and distribution of openings, both in a particular oven and in a particular wall structure, can be appropriately controlled, varied and selected to meet the specific requirements for particular applications.

In view of the above, it will be appreciated that the invention generally provides improved oven assemblies and associated or related methods of operation for the cooking of food products. In particular, the invention generally provides such oven assemblies and associated or related methods of operation for the cooking of food products such as to produce or result in even heat energy distribution within the cooking chamber cavity. Thus, the oven assemblies and methods of the invention can desirably produce or result in final food products of increased and desired uniformity.

Those skilled in the art and guided by the teachings herein provided will appreciate that the invention can desirably be applied or practiced in ovens of various sizes and types. For example and without unnecessarily limiting the broader practice of the invention, the invention can desirably be applied to full-sized commercial convection ovens, half-sized convection ovens, combination ovens and vertical conveyor ovens, for example. Further, the pan orientation of the food products being cooker therein can be front to back or side to side, as may be desired in a particular application.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An oven assembly for the cooking of food products, the oven assembly comprising:

a cooking chamber defined at least in part by a first pair of oppositely disposed first and second wall structures, each of the first and second wall structures including a plurality of spaced apart openings for the passage of air therethrough; and a rotating valve comprising at least one side wall forming a hollow cylinder with first and second opposed open ends, a separator wall disposed within said hollow cylinder separating said first and second opposed open ends, and said at least one side wall forming diametrically opposed first and second fluid openings disposed on opposite sides of said separator wall and revolvable around a longitudinal axis of rotation of said rotating valve, said rotating valve in both heated air receiving communication and return air communication with a heat source, the rotating valve in heated air distributing communication with the first wall structure and in return air communication with the second wall structure of the first pair of oppositely disposed first and second wall structures at a selected point in time such that heated air is passed through the plurality of spaced apart openings in the first wall structure into the cooking chamber and return air from the cooking chamber is passed through the plurality of spaced apart openings in the oppositely disposed second wall structure and to the rotating valve for return to the heat source, the rotating valve being capable of rotation to be in heated air distributing communication with the second wall structure and in return air communication with the first wall structure.

2. The oven assembly of claim 1 additionally comprising the heat source, wherein the heat source comprises a burner assembly.

3. The oven assembly of claim 1 wherein the cooking chamber comprises a baking chamber for the baking of selected food products.

4. The oven assembly of claim 1 wherein the cooking chamber is sized to stationarily contain at least one food-carrying rack within the cooking chamber, the rack including a plurality of support members for carrying the food products.

5. The oven assembly of claim 1 wherein the rotating valve is continuously rotatable.

6. The oven assembly of claim 1 wherein the rotating valve is rotatable at a rate of about one-half to five revolutions per minute.

7. The oven assembly of claim 1 wherein the rotating valve is rotatable in a back and forth fashion.

8. The oven assembly of claim 1 wherein the cooking chamber surrounds the food products being cooked and the rotating valve is rotatable such that the food products are cooked with even heat energy distribution while the food products remain stationary.

9. A commercial baking oven assembly for the baking of food products, the oven assembly comprising:

a baking chamber defined at least in part by a first pair of oppositely disposed first and second wall structures, each of the first and second wall structures including a plurality of spaced apart opening for the passage of air therethrough and a generally cylindrical shaped rotating valve comprising a cylindrical shaped side wall forming first and second opposed open ends, a laterally disposed opening proximate each of said open ends and a transversely oriented separator wall disposed between said laterally disposed openings and separating said first and second opposed open ends from each other, said rotating valve in both heated air receiving communication and return air communication with a burner assembly, the rotating valve in heated air distributing communication with the first wall structure and in return air communication with the second wall structure of the first pair of oppositely disposed wall structures at a selected point in time such that heated air is passed through the plurality of openings in the first wall structure into the baking chamber and return air from the baking chamber is passed through the plurality of openings in the oppositely disposed second wall structure and to the rotating valve for return to the burner assembly, the rotating valve being capable of rotation to be in heated air distributing communication with the second wall structure and in return air communication with the first wall structure of the first pair of oppositely disposed wall structures at a subsequent selected point in time.

10. The oven assembly of claim 9 wherein the rotating valve is continuously rotatable.

11. The oven assembly of claim 9 wherein the rotating valve is rotatable at a rate of about one-half to five revolutions per minute.

12. The oven assembly of claim 9 wherein the cooking chamber surrounds the food products being cooked and the rotating valve is rotatable such that the food products are cooked with even heat energy distribution while the food products remain stationary.

13. A method of operating an oven for the cooking of food products with even heat energy distribution, the oven including a cooking chamber defined at least in part by a first pair of oppositely disposed first and second wall structures, each of the first and second wall structures including a plurality of spaced apart openings for the passage of air therethrough, the oven including a generally cylindrical shaped rotating valve in both heated air receiving communication and return air communication with a heat source, said method comprising:

passing heated air from the heat source through one of a first open end and an opposed second open end of a cylindrical housing of the cylindrical shaped rotating valve, said first open end and said second open end separated by a separation wall disposed within said cylindrical housing, through one of a first cylindrical housing side wall opening disposed on a first open end side of said separation wall and a second cylindrical housing side wall opening disposed on a second open end side of said separation wall, and through the spaced apart openings in the first wall structure into the cooking chamber, and passing return air from the cooking chamber through the spaced apart openings in the second wall structure and through the other of said first cylindrical housing side wall opening and said second cylindrical side wall opening and through the other of said first open end and said second open end of the rotating valve to the heat source; and rotating the rotating valve whereby flow of heated air from the heat source through the rotating valve and through the spaced apart openings in the second wall structure into the cooking chamber and flow of return air from the cooking chamber through the spaced apart openings in the first wall structure is reversed.

14. The method of claim 13 wherein the rotating valve rotates continuously.

15. The method of claim 13 wherein the rotating valve rotates at a rate of about one-half to five revolutions per minute.

16. The method of claim 13 wherein the rotating valve rotates in a back and forth fashion.

17. The method of claim 13 wherein the cooking chamber surrounds the food products being cooked and the rotating valve rotates such that the food products are cooked with even heat energy distribution while the food products remain stationary.

* * * * *